United States Patent [19]

Kasprzak et al.

[11] Patent Number: 4,810,253

[45] Date of Patent: Mar. 7, 1989

[54] METHOD OF IMPROVING THE DRAINING OF WATER FROM TEXTILES DURING A LAUNDERING OPERATION

[75] Inventors: Kenneth A. Kasprzak, Township of Saginaw, Saginaw County; John D. Blizzard, Bay City, both of Mich.

[73] Assignee: Dow Corning Corporation, Midland, Mich.

[21] Appl. No.: 718,403

[22] Filed: Apr. 1, 1985

[51] Int. Cl.[4] ..... D06M 15/00

[52] U.S. Cl. ..... 8/137; 427/242; 252/8.8; 8/DIG. 1

[58] Field of Search ..... 252/174.15, 8.8; 8/137, 8/581, DIG. 1; 427/387, 393.3, 242; 428/447, 266, 391

[56] References Cited

U.S. PATENT DOCUMENTS 4,247,592 1/1981 Kalinowski ..... 428/266
4,290,896 4/1981 Gordon et al. ..... 210/710
4,416,793 11/1983 Barrat et al. ..... 252/174.15
4,446,033 5/1984 Barrat et al. ..... 252/8.8

FOREIGN PATENT DOCUMENTS 0075989 4/1983 European Pat. Off. .
1549180 7/1979 United Kingdom .

*Primary Examiner*—Paul Lieberman
*Assistant Examiner*—John F. McNally
*Attorney, Agent, or Firm*—Jim L. DeCesare

[57] ABSTRACT

A method of laundering textiles is disclosed wherein aminofunctional silicone is dispersed in the rinse water to improve the flow of water out of the textiles during the subsequent spin-separation of water. The resulting textiles contain less residual water and can be dried more rapidly and energy efficiently. The useful aminofunctional silicones are characterized as having either an average of 25 to 125 siloxane units per molecule with 4 to 15 percent of the siloxane units being aminoalkyl substituted or an average of 400 to 600 siloxane units per molecule with 1 to 15 percent of the siloxane units being aminoalkyl substituted.

10 Claims, No Drawings

METHOD OF IMPROVING THE DRAINING OF WATER FROM TEXTILES DURING A LAUNDERING OPERATION

BACKGROUND OF THE INVENTION

This invention relates to a method of laundering clothing and textiles in an aqueous wash bath. In particular it relates to a method of facilitating the flow of water out of clothing and textiles during the final rinse stage of the laundering cycle by using small amounts of aminoalkyl-containing polydiorganosiloxane in the rinse bath.

Automatic clothes washing machines employ a variety of wash cycles with a number of machine stages which usually include an agitated wash using an aqueous detergent solution, a spin-filter to remove the aqueous detergent solution and soil, an agitated rinse bath to remove residual detergent and soil, and a final spin-filter to remove the aqueous rinse bath. After the final spin-filter stage, the water retained in the clothing and textiles is removed by a drying step which typically includes blowing heated air over the tumbling textiles in a clothes drying machine.

The thermal drying of clothes and textiles is time consuming and requires considerable energy. Consequently, it is an object of the present invention to facilitate the drying of clothes and textiles after laundering by providing a method of washing clothes and textiles wherein the amount of water retained in the fabric after the final spin-filter, is reduced.

It has been known for a long time to employ fabric conditioning compositions in the rinse step of textile laundering to confer on textiles such well-known benefits as softening, anti-wrinkling, smoothness, ease-of-ironing, whitening and perfuming. The active softening ingredient is usually selected from the group of cationic and/or nonionic fabric substantive agents. Well-known cationic fabric softening agents include the organic quaternary ammonium compounds having either one or two higher alkyl substituents such as ditallowdimethylammonium chloride and tallowtrimethylammonium chloride. Nonionic softening actives include polyethoxylates, fatty acid esters, paraffins, fatty alcohols and fatty acids.

Great Britain Patent Specification No. 1,549,180 further teaches fabric conditioning compositions comprising a combination of organic cationic fabric-softening agents and certain types of silicone materials. The combination is reported to provide a very desirable softening effect and such additional benefits as ease-of-ironing for the textile. The Great Britain patent also teaches that if normal commercial silicones are applied to fabrics from dilute aqueous systems, they are not substantive to a useful degree, in that insufficient silicone is present in the dilute residual liquor in the fabric to provide any appreciable effect. On the other hand, it is taught that the silicone in the presence of the organic cationic agent tends to migrate with the organic cationic agent to the surface of the fabric where it is sufficiently concentrated to provide fabric conditioning benefits. Silicones with cationic character such as the hydrochloride salt derivative of polydimethylsiloxane substituted with dimethylaminopropyl groups are included among the types of silicone employed with the organic cationic fabric-softening agent.

U.S. Pat. No. 4,247,592 teaches a method for treating synthetic textiles with aminoalkyl-containing polydiorganosiloxanes to provide a crosslinked siloxane on the surface of the treated fiber without diminishing the fire-retardancy rating of the fibers. It is taught specifically that appropriate polydiorganosiloxanes contain an average of up to 100 dimethylsiloxane units and two nitrogen-containing siloxane units per molecule, where the nitrogen-containing siloxane units have a substituent such as $-CH_2CH_2CH_2NHCH_2CH_2NH_2$. It is further taught that the "hand" of nylon fabric can be improved by adding specified polydiorganosiloxanes to the rinse water while washing the fabric in an automatic clothes washing machine.

Neither of the above references suggest in any way that polydiorganosiloxanes can be used during textile laundering to improve the draining of water out of the textiles during the final rinse step. However, in another art area, U.S. Pat. No. 4,290,896 teaches that a wide variety of silicone materials can be used in fine coal dewatering processes to improve the separation of water from the coal. Among the silicone materials described in this reference is a polydiorganosiloxane containing 98 dimethylsiloxane units and 2 siloxane units having $-CH_2CH_2CH_2NHCH_2CH_2NH_2$ as a substituent.

SUMMARY OF THE INVENTION

The present invention relates to a method of laundering textiles including the steps of agitating the textiles in an aqueous wash bath, separating the aqueous wash bath from the textiles, agitating the textiles in an aqueous rinse bath, separating the aqueous rinse bath from the textiles, and drying the textiles. The improvement in the method comprises dispersing an amount, sufficient to improve the water draining, of a polysiloxane in the aqueous rinse prior to separating the rinse bath from the textiles. The polysiloxane is a triorganosiloxane-endblocked polydiorganosiloxane selected from the group consisting of low-viscosity polysiloxanes and high-viscosity polysiloxanes, the low-viscosity polysiloxanes having an average of 25 to 125 siloxane units per molecule with 4 to 15 percent of the siloxane units being nitrogen-containing siloxane units, the high-viscosity polysiloxanes having an average of 400 to 600 siloxane units per molecule with 1 to 15 percent of the siloxane units being nitrogen-containing siloxane units. The nitrogen-containing siloxane units bear a substituent of the formula $$-R'(NHCH_2CH_2)_nNHR''$$

wherein n is 0 or 1, R′ denotes an alkylene radical of 3 to 6 carbon atoms, and R″ denotes a hydrogen radical or an alkyl radical of 1 to 6 carbon atoms, and substantially all other organic substituents in the polydiorganosiloxane are methyl groups.

DETAILED DESCRIPTION OF THE INVENTION

This invention is based on the discovery that a small amount of silicone, dispersed in the final rinse water during the laundering of textiles, improves the flow of water out of the textiles during the subsequent spin-filter operation so that the textiles contain less residual water and can be dried more rapidly and energy efficiently. In general, it has been found that a fairly wide variety of silicone materials provide some improvement in water draining from textiles. Most important for the present invention, it has been discovered that the extent of improvement in water draining is surprisingly greater when certain classes of aminoalkyl-containing polydiorganosiloxanes are employed.

Although the exact manner in which the polysiloxane improves the flow of water out of the textiles is not completely understood, it does appear that the amino functionality of the polysiloxane is important in providing attraction for the silicone to the fabric surface and thus positioning the silicone at the textile water interface where the silicone's effect on water draining can be most fully expressed.

The silicone composition that is dispersed in the aqueous rinse bath in accordance with this invention consists essentially of a triorganosiloxane-endblocked polydiorganosiloxane which contains aminoalkyl substituents. The silicone can be dispersed in the rinse water by any convenient method either as a single component or combined with other laundry additives such as fabric conditioning compositions. Generally it is most convenient to prepare an aqueous composition containing a suspension or an emulsion of the aminofunctional silicone and then add appropriate amounts of the aqueous composition to the rinse water in the automatic clothes washing machine. Alternatively, aqueous suspensions or emulsions of the aminofunctional silicone can be combined with fabric conditioning compositions and subsequently added to the rinse water.

Any suitable aqueous suspension or emulsion of the aminofunctional silicone can be employed in accordance with this invention. Generally, it is preferred to employ a silicone emulsion or suspension which is stable in the rinse bath in the presence of the residual amounts of detergent components which may be present. Preferred aqueous emulsions for the method of this invention may be prepared by emulsifying the aminofunctional silicone in water using a suitable emulsifying agent such as a nonionic emulsifying agent.

Any amount of silicone that improves the dewatering of textiles during the spin-filter step of the laundering process can be employed in accordance with this invention. In most instances it is desirable for economy to employ very small amounts of the aminofunctional silicone in the rinse water. For example, it is preferred to use only about 0.01 to 0.5 gram of silicone per liter of rinse water. It is even more preferred to use 0.025 to 0.25 gram of silicone per liter of rinse water. While greater amounts of silicone will improve the draining of water from textiles according to this invention, the use of greater amounts is less preferred because of economic considerations and because the use of the greater amounts may result in significant attachment of silicone to the textiles which tends to make the textiles hydrophobic and to reduce the ability of the textiles to rapidly absorb water during subsequent use.

The triorganosiloxane-endblocked polydiorganosiloxanes (aminofunctional silicone) consist essentially of terminal triorganosiloxane units of the formula $R_3SiO_{1/2}$ and backbone diorganosiloxane units of the formula $R_2SiO_{2/2}$. Trace amounts of other siloxane units in aminofunctional silicone, such as $SiO_{4/2}$ and $RSiO_{3/2}$, which are normally present as impurities in commercial polydiorganosiloxanes may be present. Preferably there are no $SiO_{4/2}$ units and $RSiO_{3/2}$ units in the aminofunctional silicones. The R radicals of the above siloxane units are substantially either nitrogen-containing radicals of the formula $—R'(NHCH_2CH_2)_nNHR''$ or methyl radicals. In the above formula R′ denotes an alkylene radical of 3 to 6 carbon atoms, such as $—CH_2CH_2CH_2—$, $—CH_2CH_2CH_2CH_2—$, $—CH_2CH(CH_3)CH_2—$, $—CH_2CH_2CH_2CH_2CH_2—$, and $—CH_2CH(CH_2CH_3)CH_2—$. Aminofunctional silicones wherein the silicon bonded, nitrogen-containing radicals have a trimethylene radical or an alkylated trimethylene radical, such as $—CH_2CH(CH_3)CH_2—$, as the R′ radical are preferred because of ease of synthesis and availability.

R″ denotes a hydrogen radical, which is a preferred R″ radical, or an alkyl radical of 1 to 6 carbon atoms, such as methyl, ethyl, propyl, butyl, and isobutyl.

In accordance with the above, triorganosiloxane-endblocked polydiorganosiloxanes suitable for use in the method of this invention consist essentially of siloxane units selected from the following: $R''NH(CH_2CH_2NH)_nR'(CH_3)_2SiO_{1/2}$, $R''NH(CH_2CH_2NH)_nR'(CH_3)SiO_{2/2}$, $(CH_3)_3SiO_{1/2}$, and $(CH_3)_2SiO_{2/2}$. The preferred nitrogen-containing radical is $—CH_2CH(CH_3)CH_2NHCH_2CH_2NH_2$ thereby giving rise to preferred nitrogen-containing siloxane units of the formulae $H_2NCH_2CH_2NHCH_2CH(CH_3)CH_2Si(CH_3)_2O_{1/2}$ and $H_2NCH_2CH_2NHCH_2CH(CH_3)CH_2Si(CH_3)O_{2/2}$.

There are two types of aminofunctional silicone polymers, based on the degree of polymerization and extent of functionality of the polymer, which are especially useful in the method of the present invention because of their superior ability to increase the draining of water out of textiles. The first type of aminofunctional silicone polymers are denoted as low-viscosity polysiloxanes and are characterized by having an average of 25 to 125 siloxane units per molecule with 4 to 15 percent of the siloxane units being nitrogen-containing siloxane units. In other words, the low-viscosity polysiloxanes have a degree of polymerization of 25 to 125 and an amine functionality of 4 to 15 mole percent. It is even more preferred that the low-viscosity polysiloxanes have an average of 50 to 100 siloxane units per molecule with 4 to 10 percent of the siloxane units being nitrogen-containing siloxane units.

The second type of aminofunctional silicone polymers are denoted as high-viscosity polysiloxanes and are characterized by having an average of 400 to 600 siloxane units per molecule with 1 to 15 percent of the siloxane units being nitrogen-containing siloxane units. In other words, the high-viscosity polysiloxanes have a degree of polymerization of 400 to 600 and an amine functionality of 1 to 15 mole percent. It is even more preferred that the high-viscosity polysiloxanes have an average of 400 to 500 siloxane units per molecule with 1 to 5 percent of the siloxane units being nitrogen-containing siloxane units.

Methods for preparing the triorganosiloxane-endblocked polydiorganosiloxane polymers that are employed according to this invention are well known in the art. Thus, a triorgano- siloxane-endblocked polydiorganosiloxane bearing a number of suitably reactive groups per molecule, such as $\equiv SiH$ or $\equiv SiCH_2CH_2CH_2Cl$, may be reacted with $CH_2{=}C(CH_3)CH_2NH_2CH_2NH_2$ or $H_2NCH_2CH_2NH_2$, respectively, to provide an analogous polydiorganosiloxane wherein the reactive groups have been converted to $—CH_2CH(CH_3)CH_2NHCH_2CH_2NH_2$ groups and $CH_2CH_2CH_2NHCH_2CH_2NH_2$ groups, respectively. Alternatively, a suitable aminofunctional silicone may be prepared from aminoalkyl-substituted silanes or siloxanes using well-known methods of hydrolysis and equilibration. For example, Pike et al., U.S. Pat. No. 3,033,815, Speier, U.S. Pat. No. 3,146,250 and Brown, U.S. Pat. No. 3,355,424 contain teachings which may be adapted to prepare aminofunctional silicones which are suitable for use in the method of this invention.

A preferred aminofunctional silicone for the method of this invention may be prepared by hydrolyzing $H_2NCH_2CH_2NHCH_2CH(CH_3)CH_2Si(CH_3)(OCH_3)_2$ in excess water and equilibrating the resulting hydrolyzate with dimethylcyclopolysiloxane and decamethyltetrasiloxane using a base catalyst such as KOH, to provide a polysiloxane having an appropriate degree of polymerization and amine functionality.

The method of this invention is further illustrated by the following examples, however, the examples should not be regarded as limiting the invention which is delineated by the appended claims.

In the examples, all parts are by weight unless otherwise indicated. Amine neutral equivalent (ANE) denotes the parts by weight of a material that is required to provide 14.007 parts by weight of amine and/or amine salt nitrogen. It was determined by dissolving the sample in a mixture of toluene and glacial acetic acid and titrating the solution anhydrously with perchloric acid to a methyl violet endpoint.

EXAMPLE 1

This example illustrates the methods of preparing aminoalkyl-containing polysiloxanes using a hydrolysis and equilibration procedure.

Preparation of 450 D.P. Polydiorganosiloxane with 1.8 Percent of Amine-Containing Siloxane Units A mixture of 1,900.4 g (25.59 mols Si) of polydimethylsiloxane cyclics, 81.4 g (0.464 mol Si) of hydrolyzate of $CH_3(CH_3O)_2SiCH_2CHCH_3CH_2NHCH_2CH_2NH_2$, and 18.2 g (0.239 mol Si) of $(CH_3)_3SiOSi(CH_3)_2OSi(CH_3)_2OSi(CH_3)_3$ was heated to 150° C. under a nitrogen purge and then 11.31 g (0.143 mol Si) of potassium silanolate was added. The mixture was maintained for 4 hours at 150° C. under nitrogen purge to remove water and to equilibrate the siloxane units. The product was cooled to 38° C., treated with 0.68 g of acetic acid to neutralize the potassium catalyst, and filtered. The product was stripped to 150° C./25 mm Hg to remove volatile cyclics (about 7 weight percent) remaining after the equilibration process. The stripped polysiloxane fluid has a viscosity of 2845 cs at 25° C. and an ANE of 2091. The polysiloxane fluid is represented generally by the average formula $$(CH_3)_3SiO[(CH_3)_2SiO]_{440}(\underset{\underset{CH_2CH(CH_3)CH_2NHCH_2CH_2NH_2}{|}}{CH_3SiO})_8Si(CH_3)_3$$

and is generally described as having a nominal degree of polymerization (D.P.) of 450 with 1.8 percent of amine-containing siloxane units.

Preparation of 50 D.P. Polydiorganosiloxane with 4.5 Percent of Amine-Containing Siloxane Units A mixture of 77.99 parts of the hydrolyzate of dimethyldichlorosilane, 11.93 parts of $CH_3(CH_3O)_2SiCH_2CH(CH_3)CH_2NHCH_2CH_2NH_2$, 7.47 parts of $(CH_3)_3SiOSi(CH_3)_2OSi(CH_3)_2OSi(CH_3)_3$, 2.43 parts of water, and 0.17 part of 40 weight percent KOH in water was heated to 80° C. and purged with nitrogen until most of the water and methanol was removed. The mixture was heated to 150° C. and held at that temperature for 16 hours. The product was cooled, 0.17 part of $NaHCO_3$ was added to neutralze the potassium catalyst, and the product was filtered. The filtered polysiloxane fluid has a viscosity of about 83 cs at 25° C., an ANE of 843, and contains about 13 weight percent of volatile cyclic siloxanes and 87 weight percent of linear polysiloxanes. The polysiloxane fluid is represented generally by the average formula $$(CH_3)_3SiO[(CH_3)_2SiO]_{45.75}(\underset{\underset{CH_2CH(CH_3)CH_2NHCH_2CH_2NH_2}{|}}{CH_3SiO})_{2.25}SiMe_3$$

and is described as having a nominal degree of polymerization (D.P.) of 50 with 4.5 percent of amine-containing siloxane units.

EXAMPLE 2

A standard bundle of 86% cotton/14% polyester towels was washed in an automatic clothes washer using a normal wash cycle comprising a wash/spin/rinse/spin sequence. The bundle was washed five times using a laundry detergent and then five times in only water. After completion of the final rinse/spin portion of the wash cycles, the bundle was weighed and the weight percent of water retained by the towels was calculated. The towels were then dried to a standard moisture content in an electric clothes drier connected to a meter for measuring the watt-hours of energy consumed in drying the towels.

The bundle of towels was then run through another wash cycle using only water except that an emulsion of polysiloxane was dispersed in the rinse bath via the fabric-softener dispenser located on the agitator of the automatic clothes washer. After completion of the rinse/spin portion of this wash cycle, the towels were again weighed and the weight percent of water retained was calculated. The towels were again dried to the standard moisture content and the amount of energy required was measured.

The difference between the weight percent of water retained using a polysiloxane in the rinse and the weight percent of water retained without the polysiloxane in the rinse is shown in Table 1 for a number of polysiloxanes of varying degree of polymerization and amine functionality prepared by the procedure of Example 1. Negative values indicate that less water was retained in the fabric when the polysiloxane was present in the rinse water. Table 1 also shows the percent change in watt-hours of energy required to dry the towels. Again negative values indicate that less energy is required to dry the towels after the rinse containing polysiloxane in comparison to the rinse without the polysiloxane.

The polysiloxane emulsions used in the washing tests were prepared by mixing 4.4 g of 2,6,8-trimethyl-4-nonyl(oxyethylene)$_6$ alcohol and 12.4 g of octophenyl-(oxyethylene)$_{40}$ alcohol nonionic surfactants with 76.1 g of water and then slowly adding 50 g of the polysiloxane while the mixture is being homogenized on a colloid mill.

TABLE 1

| Polydiorganopolysiloxane | | | | Results | |
|---|---|---|---|---|---|
| Trial No. | Nominal D.P. | Nitrogen-Containing Siloxane Units per Molecule | Amount (g) per 1 $H_2O$ in Rinse | Difference in Wt. % $H_2O$ Retained | % Change in Watt-Hours |
| 1 | 50 | 2.25 | 0.10 | −14.9 | −9.5 |
| 2 | 50 | 2.25 | 0.10 | −18.8 | −7.6 |
| 3 | 50 | 2.25 | 0.10 | −23.2 | −11.5 |
| 4 | 100 | 8 | 0.05 | −11.8 | −6.0 |
| 5 | 100 | 8 | 0.10 | −15.2 | −10.0 |
| 6 | 100 | 8 | 0.10 | −18.3 | −8.0 |
| 7 | 100 | 8 | 0.15 | −14.5 | −9.0 |
| 8 | 450 | 8 | 0.10 | −23.3 | −10.5 |
| 9 | 450 | 8 | 0.10 | −16.0 | −9.5 |

EXAMPLE 3

This example illustrates the results obtained when amine-containing polydiorganosiloxanes outside the scope of the present invention are employed in the rinse water during fabric laundry operations. This example is presented for comparison purposes only.

The washing test of Example 2 was repeated using a number of polysiloxanes prepared by the procedure of Example 1 but with different ranges of polymerization and amine content. The effect of these polysiloxanes on the amount of water retained in the towels after the spin separation of rinse water is shown in Table 2.

TABLE 2

| Polydiorganopolysiloxane | | | | Results | |
|---|---|---|---|---|---|
| Trial No. | Nominal D.P. | Nitrogen-Containing Siloxane Units per Molecule | Amount (g) per 1 $H_2O$ in Rinse | Difference in Wt. % $H_2O$ Retained | % Change in Watt-Hours |
| 1[a] | 100 | 2 | 0.025 | −7.9 | −9.7 |
| 2[a] | 100 | 2 | 0.05 | −9.4 | −12.8 |
| 3 | 100 | 2 | 0.10 | +5.8 | +4.3 |
| 4[a] | 100 | 2 | 0.10 | −6.7 | −2.1 |
| 5[a,b] | 100 | 2 | 0.10 | −1.2 | +6.0 |
| 6[a] | 100 | 2 | 0.25 | −16.1 | −9.3 |
| 7 | 200 | 10 | 0.05 | −3.9 | −4.5 |
| 8 | 200 | 10 | 0.05 | −5.6 | −5.0 |
| 9 | 200 | 10 | 0.05 | −2.2 | −3.0 |
| 10 | 200 | 10 | 0.10 | −5.9 | −3.0 |
| 11 | 200 | 10 | 0.10 | −11.6 | −1.0 |
| 12 | 200 | 10 | 0.10 | −13.2 | −7.0 |
| 13 | 200 | 10 | 0.15 | −16.2 | −13.4 |
| 14 | 200 | 10 | 0.15 | −7.9 | −2.0 |
| 15 | 200 | 10 | 0.15 | −4.2 | −2.0 |
| 16 | 300 | 2 | 0.10 | +1.7 | +0.4 |
| 17 | 300 | 24 | 0.05 | −14.4 | −5.0 |
| 18 | 300 | 24 | 0.10 | −7.5 | −7.0 |
| 19 | 300 | 24 | 0.10 | −8.1 | −8.0 |
| 20 | 300 | 24 | 0.15 | −17.0 | −8.0 |

[a]Polysiloxane emulsion prepared with 1.7 parts 2,6,8-trimethyl-4-nonyl(oxyethylene)$_6$ alcohol, 3.6 parts octophenyl(oxyethylene)$_{40}$ alcohol, 1.4 parts ethylene glycol, 58.3 parts water, and 35 parts polysiloxane fluid.
[b]Polysiloxane emulsion pH adjusted to between 4 and 5 with acetic acid.

EXAMPLE 4

This example illustrates the effect obtained when a mixture of low viscosity and high viscosity polysiloxanes of this invention is employed in the rinse water during fabric laundry operations.

The washing test of Example 2 was repeated using a mixture of 50 percent by weight of polysiloxane fluid prepared by the procedure of Example 1 with a nominal degree of polymerization of 50 and an average of 2.25 siloxane units bearing the amine-containing substituent per polymer molecule and 50 percent by weight of a similarly prepared polysiloxane fluid with a nominal degree of polymerization of 450 and an average of 8 siloxane units bearing the amine-containing substituent per polymer molecule. For Trial Numbers 1 and 2, the two polysiloxane fluids were mixed and then an emulsion was prepared from the mixed fluids by the procedure described in Example 2. For Trial Number 3, an emulsion of each fluid was first prepared and then equal portions of the two emulsions were combined.

The effect of these polysiloxane mixtures on the amount of water retained in the towels after the spin separation of rinse water is shown in Table 3.

TABLE 3

| Trial No. | Amount (g) of Mixed Polysiloxane per liter $H_2O$ in Rinse | Difference in Wt. % $H_2O$ Retained | % Change in Watt-Hours |
|---|---|---|---|
| 1 | 0.10 | −15.1 | −9.7 |
| 2 | 0.10 | −18.2 | −11.2 |
| 3 | 0.10 | −17.3 | −8.5 |

EXAMPLE 5

This example demonstrates that the polysiloxanes of this invention can be used in conjunction with a conventional fabric-softening laundry additive and still provide a reduction in amount of water retained in fabric.

The washing test described in Example 2 was duplicated except that the recommended amount of a commercial fabric-softening product was dispensed into the rinse water in combination with the polysiloxane emulsion. The polysiloxane used in this test was prepared by a hydrolysis and equilibration procedure as described in Example 1 and is generally described as having a nominal degree of polymerization of 100 with 8 percent of amine-containing siloxane units.

The difference between the weight percent of water retained using the polysiloxane and fabric softener in the rinse and the weight percent of water retained without the polysiloxane or fabric softener in the rinse was −14.3. The percent change in watt-hours of energy required to dry the towels was −8.3. For comparison, the difference between the weight percent of water retained using only fabric softener in the rinse and the weight percent of water retained without an additive in the rinse was +3.3, +2.9, and +0.4 in three separate tests.

That which is claimed is:

1. In a method of laundering textiles including the steps of agitating the textiles in an aqueous wash bath, separating the aqueous wash bath from the textiles, agitating the textiles in an aqueous rinse bath, separating the aqueous rinse bath from the textiles and drying the textiles, the improvement comprising dispersing an amount, sufficient to improve the water draining, of a polysiloxane in the aqueous rinse bath prior to separating the rinse bath from the textiles wherein the polysiloxane is a triorganosiloxane-end blocked polydiorganosiloxane selected from the group consisting of low-viscosity polysiloxanes and high-viscosity polysiloxanes, the low-viscosity polysiloxanes having an average of 25 to 125 siloxane units per molecule with 4 to 15 percent of the siloxane units being nitrogen-containing siloxane units, the high-viscosity polysiloxanes having an average of 400 to 600 siloxane units per molecule with 1 to 15 percent of the siloxane units being nitrogen-containing siloxane units, the nitrogen-containing siloxane units bearing a substituent of the formula $$-R'(NHCH_2CH_2)_nNHR''$$

wherein n is 0 or 1, R′ denotes an alkylene radical of 3 to 6 carbon atoms, R″ denotes a hydrogen radical or an alkyl radical of 1 to 6 carbon atoms, substantially all other organic substituents in the polydiorganosiloxane being methyl groups, the amount of polysiloxane dispersed in the aqueous rinse bath being 0.01 to 0.5 grams per liter of water in the rinse bath.

2. A method according to claim 1 wherein the amount of polysiloxane dispersed in the aqueous rinse bath is 0.025 to 0.25 grams per liter of water in the rinse bath.

3. A method according to claim 2 wherein the polysiloxane dispersed in the aqueous rinse bath is a low-viscosity polysiloxane.

4. A method according to claim 3 wherein the low-viscosity polysiloxane has an average of 50 to 100 siloxane units per molecule with 4 to 10 percent of the siloxane units being nitrogen-containing siloxane units.

5. A method according to claim 4 wherein n is 1, R′ denotes a trimethylene or a methyl substituted trimethylene radical, and R″ denotes a hydrogen radical.

6. A method according to claim 5 wherein R′ denotes $-CH_2CH(CH_3)CH_2-$.

7. A method according to claim 2 wherein the polysiloxane dispersed in the aqueous rinse bath is a high-viscosity polysiloxane.

8. A method according to claim 7 wherein the high-viscosity polysiloxane has an average of 400 to 500 siloxane units per molecule with 1 to 5 percent of the siloxane units being nitrogen-containing siloxane units.

9. A method according to claim 8 wherein n is 1, R′ denotes a trimethylene or a methyl substituted trimethylene radical, and R″ denotes a hydrogen radical.

10. A method according to claim 9 wherein R′ denotes $-CH_2CH(CH_3)CH_2-$.

* * * * *